US006276553B1

(12) United States Patent
Vulcano

(10) Patent No.: US 6,276,553 B1
(45) Date of Patent: Aug. 21, 2001

(54) TRASH CONTAINER WITH TILTING RECEPTACLE

(75) Inventor: Vincent N. Vulcano, Oakland Park, FL (US)

(73) Assignee: Jeff Tomczak, Oakland Park, FL (US)

( * ) Notice: Subject to any disclaimer, the term of this patent is extended or adjusted under 35 U.S.C. 154(b) by 0 days.

(21) Appl. No.: 09/318,464

(22) Filed: May 25, 1999

Related U.S. Application Data

(60) Provisional application No. 60/086,692, filed on May 26, 1998.

(51) Int. Cl.[7] ..... B65D 25/18; B65D 35/14

(52) U.S. Cl. ..... 220/495.06; 220/908.1

(58) Field of Search ..... 220/495.06, 495.05, 220/495.08, 495.11, 506, 908, 908.1

(56) References Cited

U.S. PATENT DOCUMENTS

Re. 29,425 * 10/1977 Engebretsen ..... 220/495.06 X
3,861,296 * 1/1975 Clar ..... 220/908.1 X
3,885,467 * 5/1975 Merkin ..... 220/495.06 X
3,995,543 * 12/1976 Montalbano ..... 220/495.06 X
4,577,778 * 3/1986 Kim ..... 220/908.1 X
5,090,785 * 2/1992 Stamp ..... 220/495.06 X
5,381,921 * 1/1995 Bray et al. ..... 220/495.08
5,984,134 * 11/1999 Mario ..... 220/495.11 X

* cited by examiner

*Primary Examiner*—Allan N. Shoap
*Assistant Examiner*—Niki M. Eloshway
(74) *Attorney, Agent, or Firm*—Robert M. Schwartz

(57) ABSTRACT

The present invention is an improved trash container having a plastic trash bag liner mounted on a tiltable shuttle having three sides so that, when the trash container door is opened, the shuttle can be tilted causing the full trash bag liner to be removable from the open panel of the shuttle without having to lift the full trash bag up and out of the container. The shuttle can also be mounted on a movable dolly so that periodically the entire shuttle and dolly can be removed from the container for cleaning purposes.

8 Claims, 5 Drawing Sheets

TRASH CONTAINER WITH TILTING RECEPTACLE

CROSS-REFERENCES TO RELATED APPLICATIONS

This application claims the benefit of U.S. Provisional Application No. 60/086,692, filed on May 26, 1998.

BACKGROUND OF THE INVENTION

1. Field of the Invention

The field of the invention is an improved trash container having a plastic trash bag liner with an improved means for supporting and removing the plastic trash bag liner. The trash container is typically used in public areas such as parks and fast-food restaurants.

2. Description of the Related Art Including Information Disclosed under 37 CFR 1.97 and 1.98

Trash containers are well known in the prior art and have a number of names such as trash cans, garbage cans, rubbage bins, and refuse containers.

Traditionally, trash containers are rectangular in shape, having an opening at their top to receive trash. A plastic trash bag liner is typically inserted within the trash container and supported within the trash container. Trash is deposited into the plastic trash bag liner and, once full, the bag must be lifted out of the trash container and replaced with a new plastic trash bag liner. The words "bag," "bag liner" and "plastic trash bag" are interchangeable as used herein.

Bray, U.S. Pat. No. 5,381,921, issued on Jan. 17, 1995, discloses Refuse Containers. The Bray trash container has a front panel that opens forward and downwardly on a hinge at the bottom of the container. At the top of the front panel, a supporting frame holds a trash bag liner. To use the Bray trash container, the front panel is opened, a trash bag is loaded onto a supporting frame, the front panel is closed, and trash is loaded from the top. Once full, the front panel is leaned forward. Then, the trash bag is removed by lifting it up and through the supporting frame. The Bray trash container requires that the trash bag must be lifted out of the trash container. A full trash bag can weigh a significant amount and would be difficult to lift. This weight may cause the trash bag to tear under its own weight when lifted. In addition, a lifter may injure themselves while lifting the full trash bag.

Gladwin, U.S. Pat. No. 3,726,211, issued Apr. 10, 1973, discloses a trash compactor having a trash bag on a movable dolly, supported by a U-shaped bag support frame. However, to remove the trash bag liner, it is necessary to first unlatch a front door, remove the dolly from the trash compactor/container and then tilt the support frame on the movable dolly rearward back towards the trash compactor. It is thus not possible to remove the trash bag liner without first moving the dolly supporting the trash bag liner. Further, a complex tilting and latching system is used.

SUMMARY OF THE INVENTION

The invention is a trash or refuse container having there within a U-shaped bag support frame shuttle that is hinged at its forward bottom edge so as to tilt forward, away from the container, to swing an attached trash bag liner forward from the shuttle's open side for easy removal of the liner by detaching it from the shuttle without having to lift the trash bag liner out of the trash bag support frame.

The exterior of the trash container is a closed rectangular box-like structure having a front door, a rear wall and two side walls. The front door swings open on a vertical hinge attached to the right side of the container. This front door is approximately the same height as the enclosed shuttle. Above and flush with the front door is a swinging door hinged from the front top edge of the trash container. Trash is inserted into the trash container through the swinging door. The swinging door also can swing forward to provide additional clearance when the shuttle is tipped forward. Alternatively, the swinging door can be held in a rearward position by placement of a magnet on the swinging door to magnetically attach to the top of the container, to be returned to its original position after removal of the trash.

When the front door is opened, the shuttle located in the trash container is exposed. The shuttle is a U-shaped box-like structure having a bottom panel, a back wall, a right wall, and a left wall. The shuttle has a supporting frame with four generally horizontal sections around the entire top edge of the shuttle to support a trash bag that would be folded over the supporting frame. The shuttle has no front wall or top panel. The shuttle fits within the trash container.

In one embodiment, the bottom front edge of the open end of the shuttle attaches to the inside front bottom edge of the container by a hinge. The hinge allows the shuttle to pivot forward. A lateral restraint runs from the back of the shuttle to the back interior of the rectangular box. The lateral restraint limits the distance the shuttle can be leaned forward. The lateral restraint is long enough to allow the entire supporting frame to be in front of the rectangular box when the shuttle is tilted forward.

A trash bag liner is inserted into the shuttle with the top of the bag folded over the top of the shuttle's supporting frame. The supporting frame and the shuttle holds and supports the trash bag there within. The top of the supporting frame fits as close as possible against the interior front wall of the container to prevent trash from falling outside the trash bag.

When the trash bag liner is full or ready to be emptied, the shuttle is tilted forward, causing the full bag to move forward, outward and downward through the open front portion of the shuttle. The trash bag liner is removed from the shuttle supporting frame and the full bag is disposed. The full trash bag is removed from the trash container without lifting the bag above the supporting frame. The present invention thus eliminates lifting of a full trash bag and eases unloading of a full trash bag liner from a container.

Thereafter, a new trash bag liner is then inserted into the shuttle and folded over the supporting frame. The shuttle is tilted back into the rectangular body and the front panel is closed. Once full, the trash container is again emptied as heretofore described.

An alternate embodiment of the present invention includes a movable dolly to support the shuttle. It has been found that, in addition to removing the bag liner on a regular basis, it is desirable to periodically clean the interior of the entire trash container. Thus, by placing the shuttle on a movable dolly, after removal of the full trash bag liner from the container, the shuttle and its dolly can be removed from the container providing full access to clean the interior of the container, as well as the shuttle and dolly. The alternate embodiment can easily be used to retrofit an older trash container to use the present invention. It requires only that a guide be added to the interior of an existing trash container.

Additionally, it may be desirable to have additional shuttles with more dollies than the number of trash containers. In this manner, it is possible to first remove a shuttle on a dolly having a full trash bag liner from a full container, second replace the shuttle with another shuttle having an empty trash bag liner, and third move the full shuttle or shuttles into another area for unloading the full trash bag or bags, and then reload these shuttles with empty trash bags. Each time this is done, a shuttle on a dolly with an empty trash bag is immediately placed into the container, thus providing continuous service for each said container.

The shuttle system can be adapted for use with most trash containers having a front door that opens regardless of the type of top that is used on the container. For example, the shuttle system can be used with trash containers having a swinging door at their top to receive trash. Another configuration might involve a frame having a roof that allows trash to be received from all sides. In addition, trash containers having an open top can be used with the shuttle system. The top of the trash container only needs to allow the trash container to have a front door that opens to allows the shuttle to lean forward, and the shuttle to be in close proximity to the side walls of the trash container.

It is thus an object of the present invention to provide a trash container using disposable trash bag liners that can be easily removed from the container without lifting the trash bag out of a frame.

It is another object of this invention to be able to easily remove the trash bag support to clean the inside of the container and the trash bag support.

It is an object of the present invention to provide movable, interchangeable shuttles that can be removed from the trash container quickly and easily, replaced with a shuttle having an empty trash bag and remove the trash bags in another location.

It is another object of the present invention to be able to easily and inexpensively retrofit an existing trash container with the present invention.

It is an object of the present invention to have an inexpensive, easy to manufacture, and easy to use trash removal system.

DESCRIPTION OF THE PREFERRED EMBODIMENTS

Figure 2:
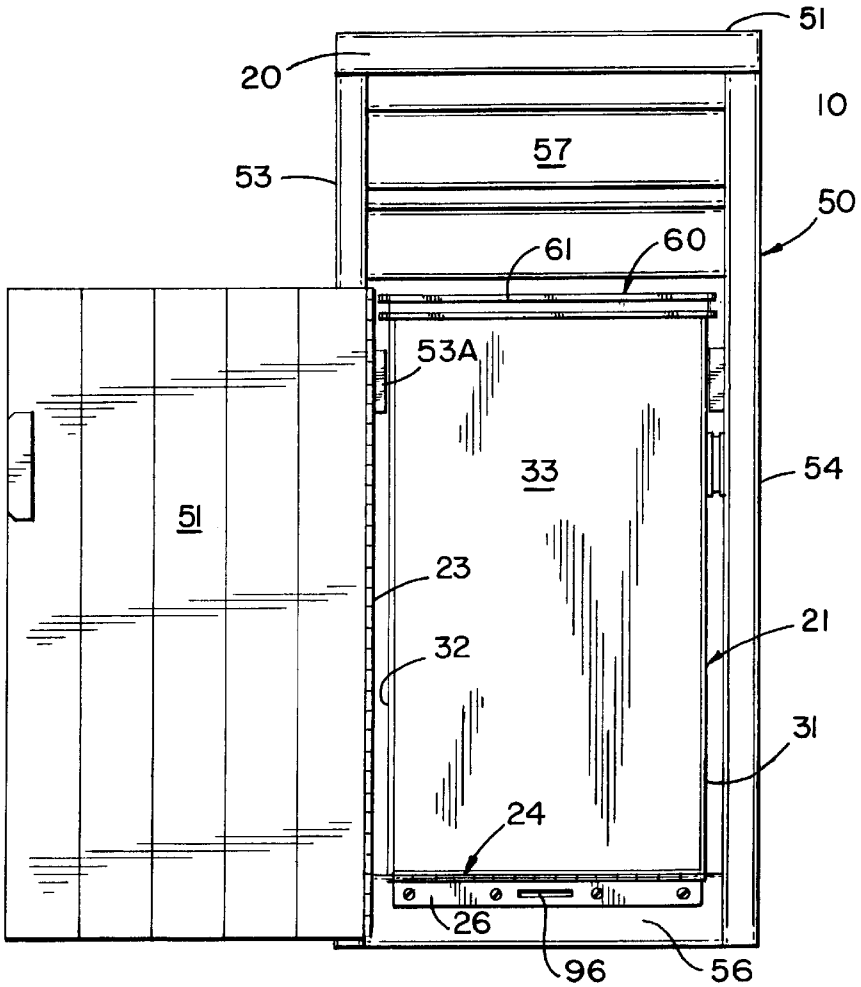
FIG. 2 is a front view of the trash container of FIG. 1 with the front door in an open position showing the hinged shuttle.
Figure 1:
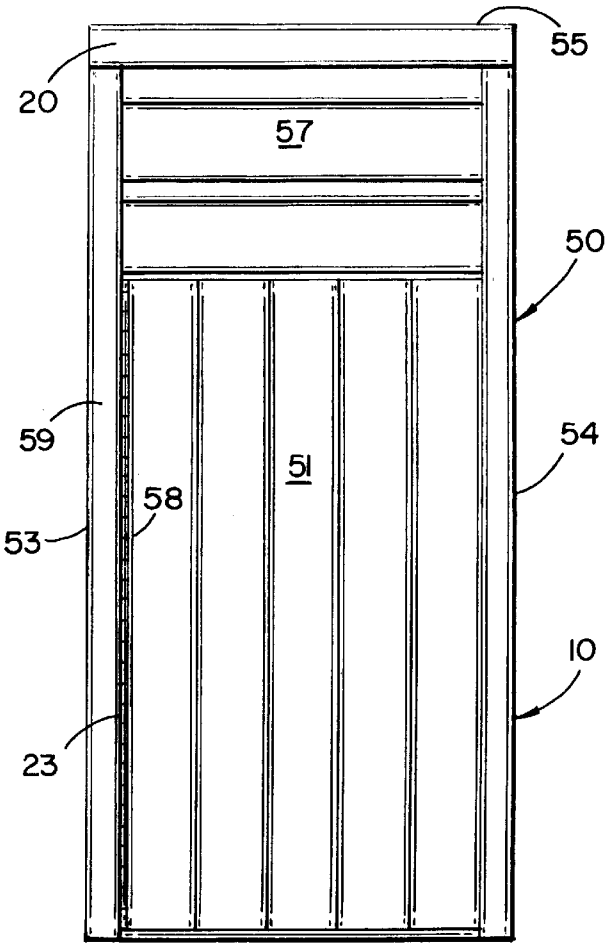
FIG. 1 is a front view of a typical trash container having a front door, shown in a closed position, and a swinging door above the front door for receiving the trash.

Trash container 10 includes a rectangular shaped box-like structure 50 and a U-shaped sheet metal support frame shuttle 21. Container box 50 is a closed rectangular box having a front door 51, a rear wall 52, a right wall 53, a left wall 54, a top panel 55, and a floor or bottom support 56 resting on a floor, the ground or other support surface, said bottom support may or may not be integral with box 50. As to the latter, bottom support would be sufficiently heavy to support shuttle 21 in a tilted position. Walls 53 and 54 include interior supports 53A and 54A, respectively. A swinging door 57 is also located on the front wall of container 50. Front door 51 extends upward from its lower end covering bottom support 56 to its upper end above the height of shuttle 21.

The right edge 58 of front door 51 is attached by vertical hinge 23 to the front edge 59 of right wall 53. Vertical hinge 23 allows front door 51 to open and close to allow access to the interior of container box 50 and shuttle 21. Above front door 51 is a swinging door 57 which hangs from a top edge 20 of container box 50. Swinging door 57 hangs vertically flush with front panel 51 and swings inward and outward on pivot 20A. Door 57 can also have a magnet (not shown) on the inside face of door 57 which would attach to top panel 55 to hold said door 57 out of the way when removing shuttle 21. This requires at least a portion of panel 55 to be of metal.

Figure 4:
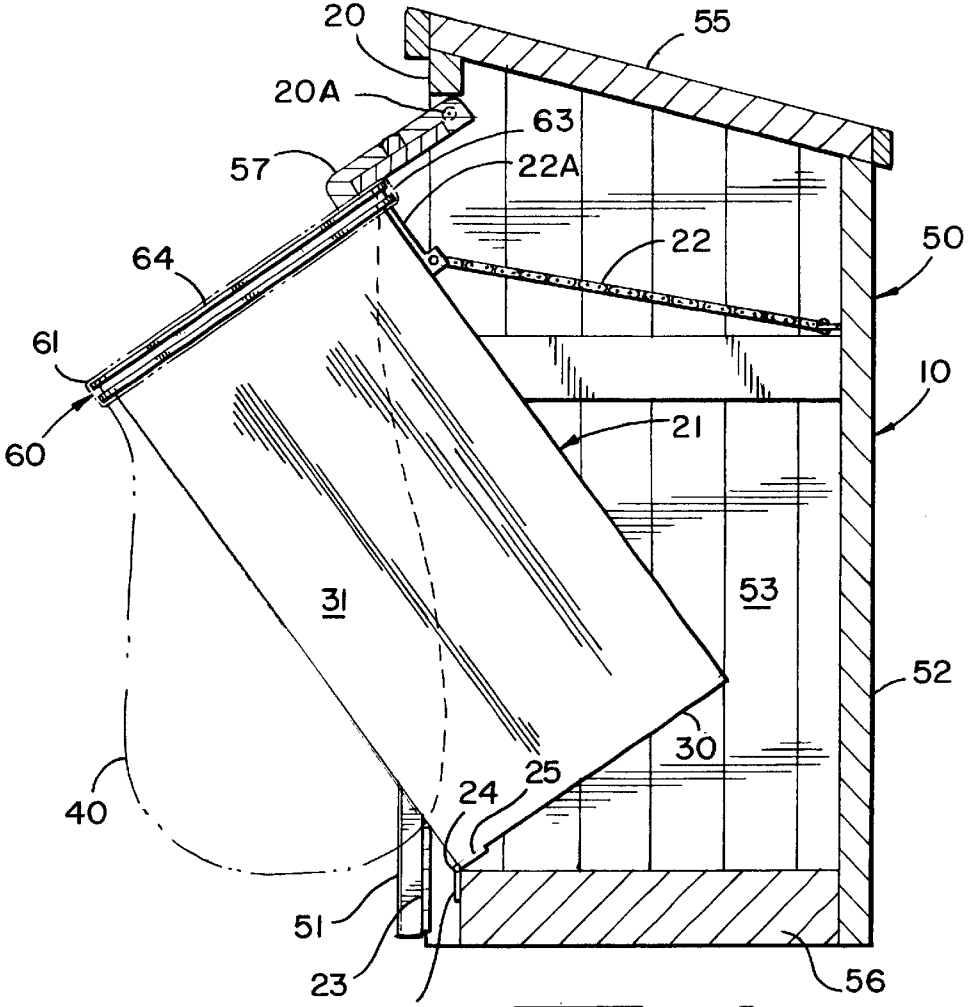
FIG. 4 is a left side, cutaway view of the trash container with the front door in an open position, showing the shuttle in a tilted position and a full trash bag liner in phantom supported by a support frame.
Figure 3:
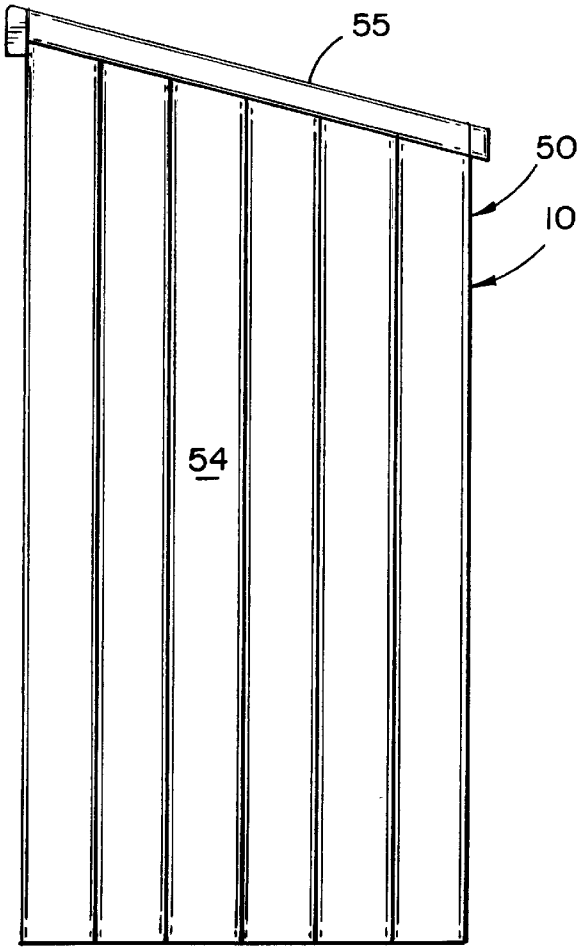
FIG. 3 is a view of the left side of the trash container of FIG. 1.

Trash (not shown) is inserted in trash container 10 through said swinging door 57. Swinging door 57 swings rearward when trash is inserted and swings forward to provide extra clearance when shuttle 21 is tilted forward (see FIG. 4).

Figure 5:
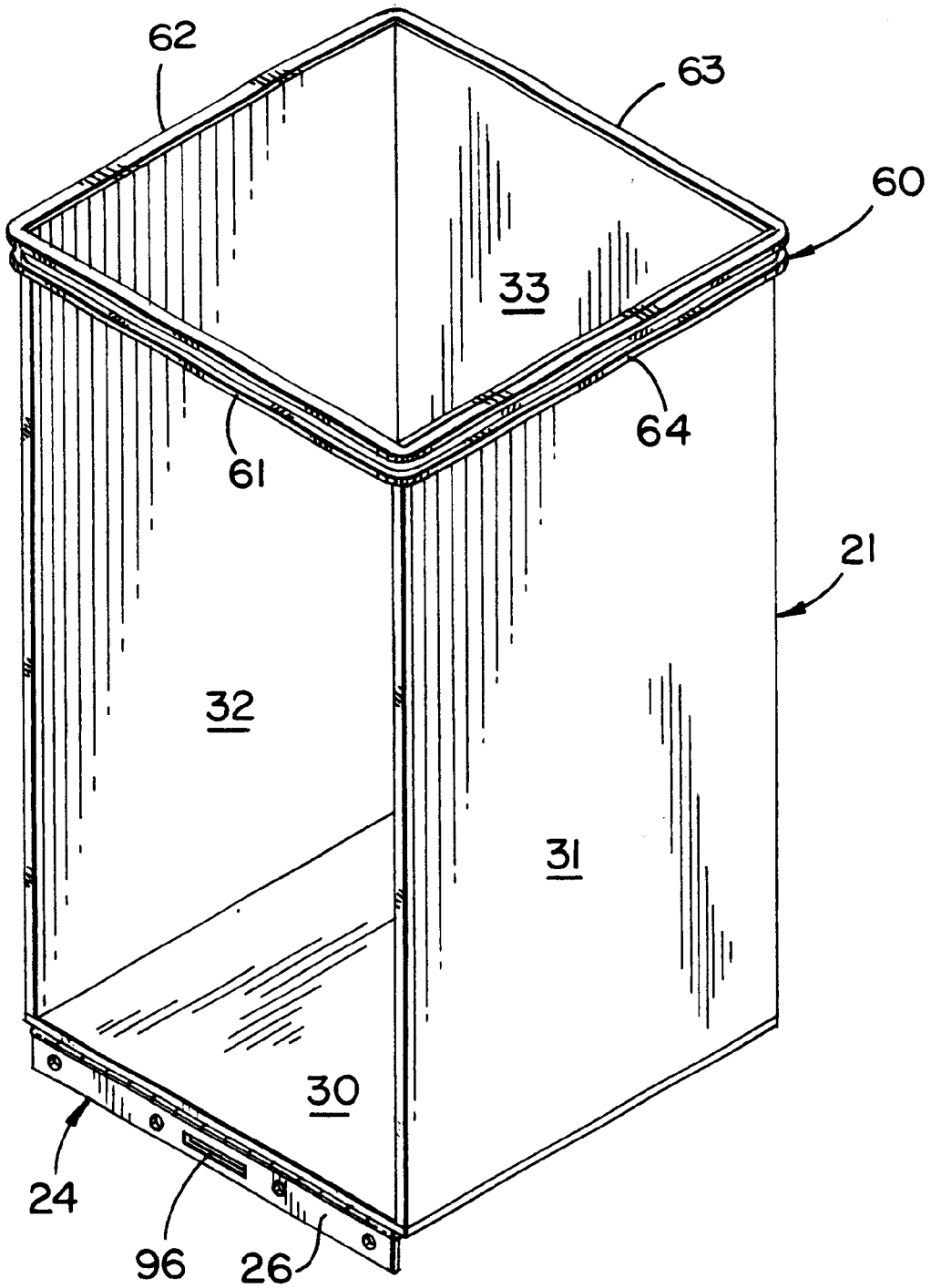
FIG. 5 is a perspective view of the three-sided shuttle, the front open portion of the shuttle, the trash bag supporting frame and the horizontal hinge attached to the front portion of the shuttle.
Figure 6:
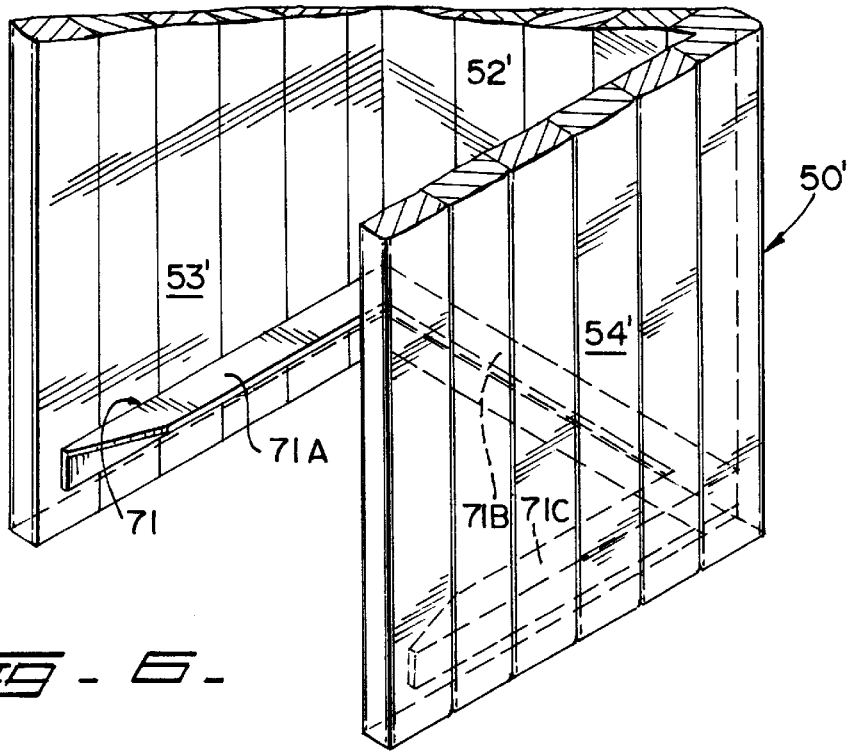
FIG. 6 is a partial perspective view of a trash container for an alternate embodiment of the present invention. Note, the numbers used in FIG. 6–9 will be the same, where applicable, as in the previous embodiment, but will use a prime indication.

Shuttle 21, FIG. 5, is a preferably U-shaped sheet metal bag support frame, having a bottom panel 30, left panel 31, right panel 32, and rear panel 33. Shuttle 21 can also be made of other materials, such as plastic or rubber. Said panels are permanently joined to each other or folded at their adjacent edges. Shuttle 21 will have a frontal opening, but does not require all left, right and rear panels. Shuttle 21 is less than the height of front door 51. Four-sided bag support frame 60 is at the top of shuttle 21 having a front bar 61, right bar 62, rear bar 63, and left bar 64, wherein each bar attaches to the adjacent bars at their ends to form a frame. Supporting frame 60 is an integral part of shuttle 21 or is connected to shuttle 21 by adhesives or by overlaying the top edges of shuttle 21, such that left bar 64 is attached to left panel 31, rear bar 63 is attached to rear panel 33 and right bar 62 is attached to right panel 32. Front bar 61 spans the open gap between the forward top edges of left panel 31 and right panel 32. In use, a plastic trash bag liner 40 is placed through supporting frame 60 and the top edge of the plastic trash bag liner 40 is folded over bag support frame 60, such that empty bag 40 drapes within shuttle 21. Thus, bag support frame 60 and shuttle 21 hold, contain and support plastic trash bag liner 40.

Shuttle 21 rests on and is supported on bottom support 56. A horizontal hinge 24 is attached on one side 25 along the frontal edge of shuttle bottom panel 30 and the other side 26 along the upper frontal edge of bottom support 56. Horizontal hinge 24 extends the approximate entire width of shuttle 21.

Shuttle 21 is also connected to container box 50 by a lateral restraint chain 22 limiting the distance that shuttle 21 can lean or tilt forward. Lateral restraint 22 is long enough such that shuttle 21 leans forward at an angle so that supporting frame 60 is entirely forward of rectangular body 50 (see FIG. 4), in order to fully expose bag 40 for easy removal. Chain 22 is attached at one end to the rear wall 52 of container 10 and at its other end to a bracket 22A on the rear of shuttle 21.

Refuse container 10 is typically used by opening front panel 51 of container box 50, tilting shuttle 21 forward, inserting an empty trash bag liner 40 through supporting frame 60 and within shuttle 21, folding the top edges of trash bag liner 40 over the edges of supporting frame 60, returning shuttle 21 to a horizontal, at rest position, and closing front panel 51. When the trash container is to be emptied, the user opens front panel 51 once trash bag 40 is full, tilting shuttle 21 forward, allowing trash bag 40 to slide forward on bottom 30 to be suspended by supporting frame 60, and removing trash bag 40 from supporting frame 60 thereby dropping it to the ground for disposal without ever having to lift plastic trash bag 40 through supporting frame 60.

An alternate embodiment of the present invention places the shuttle on a mobile dolly. When referring to this alternate embodiment, the same numbering system will be used to indicate similar parts and pieces; however, where applicable, a prime number indication will be used, e.g., in the alternate embodiment, reference to container box will be 50'.

In this alternate embodiment shown in FIGS. 6–9, shuttle 21' is attached to a movable dolly 70. As in the previous embodiment, a trash bag liner 40 is supported by a bag support frame 60. Shuttle 21' and dolly 70 can be removed from container box 50' to provide complete access to clean the inside of trash container 10' or to clean shuttle 21 and its dolly 70.

A guide 71 is located on the lower inside walls of container box 50'. The top of guide 71 is approximately 2⅝ inches above the ground level. Guide 71 is a continuous angled flange having three sections, located on the inside of container box 51', a first section 71A attached to right wall 53' of container box 50', a second section 71B attached to rear wall 52' and a third section 71C attached to left wall 54'. The top of guide 71 is approximately the same height as the top of dolly 70, providing an even, flat surface for supporting the bottom 30' of shuttle 21'. There is approximately ⅛ inch clearance between guide 71 and dolly 70.

Dolly 70 is made of sheet metal with three sides folded over, each forming a one inch lip perpendicular to the larger flat floor 70A portion of dolly 70. There is a front lip 72, right lip 73 and left lip 74. Rear side 75 of dolly 70 remains flat with no folded lip. These one inch lips 72, 73 and 74 are joined at their common ends providing structural rigidity to dolly 70.

The bottom of dolly 70 includes four wheel assemblies, 76, 77, 78 and 79. Each said wheel assembly includes a U-shaped bracket attached to the bottom of dolly 70 at one end and an axle at the other end supporting a wheel. Said wheels and brackets may be pivotable, either all of them or two of them.

Figure 7:
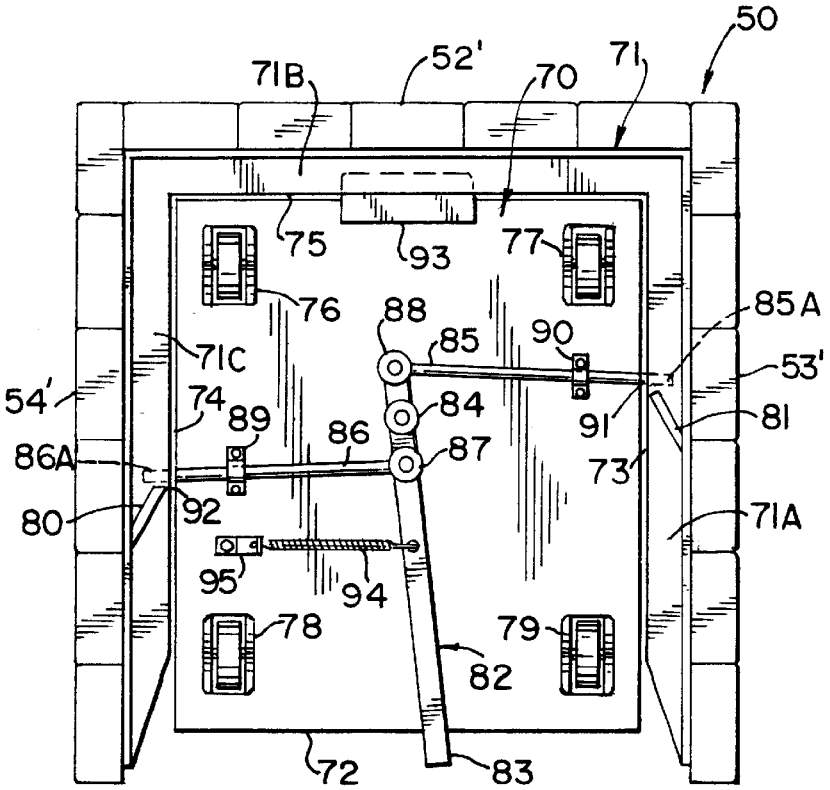
FIG. 7 is a bottom view of a trash container also showing the bottom view of a dolly.
Figure 8:
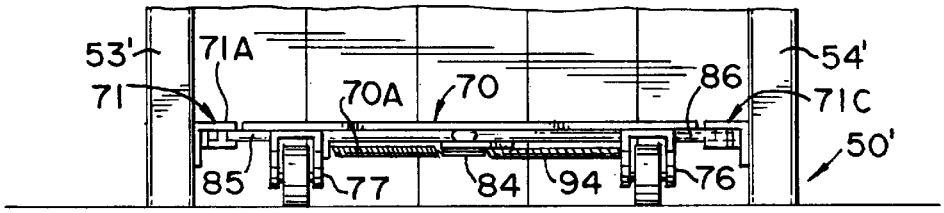
FIG. 8 is a partial front sectional view of the trash container of FIG. 6 showing a dolly frame without its shuttle. The section is made behind the hinge and, thus, the front plate and hinge of the dolly are not seen.
Figure 9:
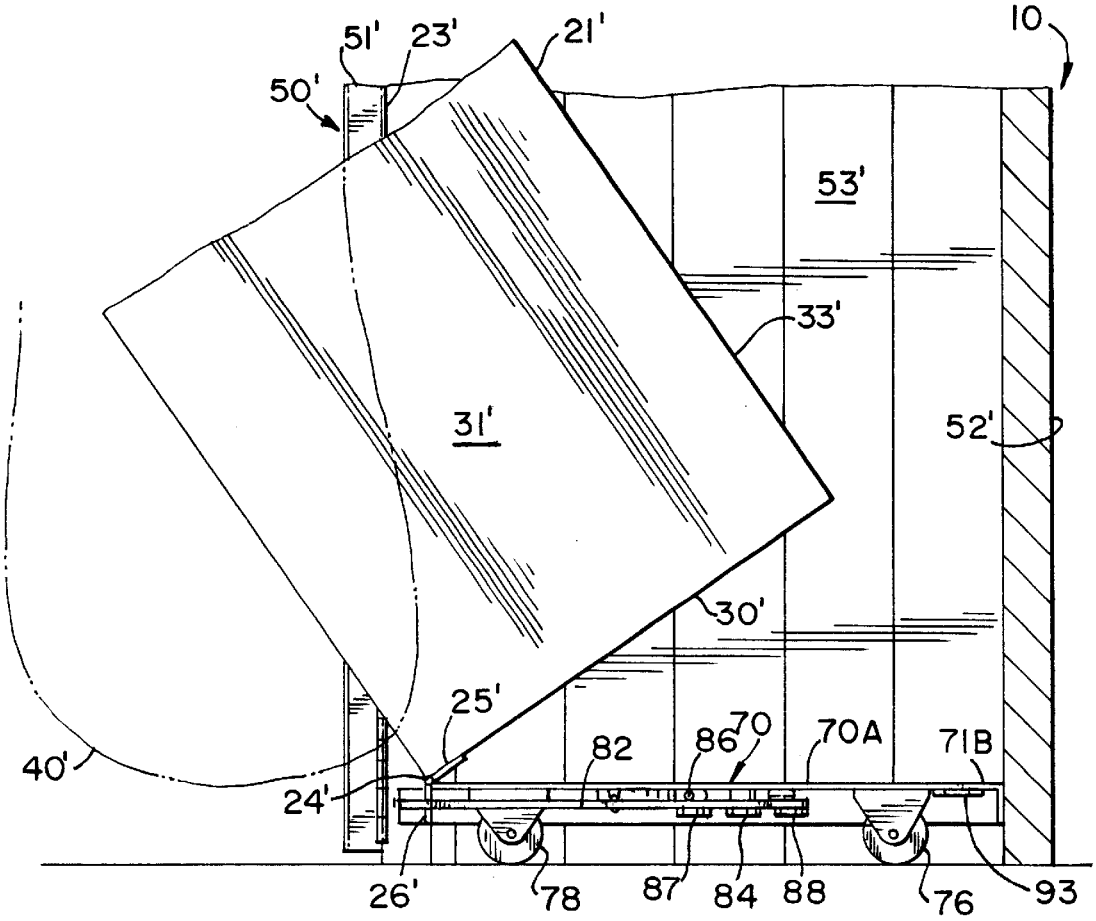
FIG. 9 shows a partial side view of the container of FIG. 6 with the shuttle in a tilted position showing the trash bag liner in a vertical position ready to be removed from the shuttle without lifting.

As seen in FIG. 7, guide 71 includes two integral opposed latches, 80 and 81, one on each side of said guide 71, displaced different distances from the front of container 51'. Dolly 70 further includes a pivoted lever arm 82, having a handle portion 83 at one end and a pivot 84 set back from the opposite end. Two rods 85 and 86 are pivotally connected to said arm 82 at pivot points 87 and 88, which are equal distances from pivot 84. Each rod extends laterally in opposite directions and generally perpendicular to arm 82. Each rod 86 and 85 is held in place by slides 89 and 90, respectively. Arm 82 is held in tension by spring 94 which is connected to a base 95 at one end and to arm 82 at its other end. Rod 85 extends outwardly through opening 91 of fold 73, such that tip 85A of rod 85 extends a sufficient distance to engage latch 81 preventing dolly 70 from moving towards the open end of container box 50'. Likewise, rod 86 extends outwardly through opening 92 of fold 74, such that tip 86A extends a sufficient distance to engage latch 80 preventing dolly 70 from moving towards the open end of container box 50'. Thus, in a rest position, spring 94 exerts tension on arm 82 causing rods 85 and 86 to remain in an extended position with tips 85A and 86A extended to engage latches 81 and 80, such that dolly 70 cannot be removed from container 50'.

A flange 93 is attached to the rear portion of dolly 70 to engage the lower portion of guide 71B to prevent the rear portion of dolly 70 from lifting and tilting upward when shuttle 21' is tilted to remove the trash bag.

A slot 96 is in front fold 72 of dolly 70 providing an opening for arm 83 to extend through said fold 72. Spring 94 is constructed and arranged to cause tension on lever arm 82, such that rods 85 and 86 extend a sufficient distance through openings 91 and 92 to engage latches 80 and 81 when it is desired to remove dolly from container 50', arm 82 is moved a sufficient distance towards wall 54' to disengage rods 85 and 86 from contact with latches 80 and 81, thus allowing dolly 70 to be moved or rolled out of container 50'.

In this alternate embodiment, trash can liner 40' is placed within shuttle 21' as in the prior embodiment. Said trash can liner is supported on frame 60 as in the prior embodiment. When the trash can liner 40' becomes full and it is desirable to empty said liner, front door 51' is opened fully and, as previously described in the prior embodiment, shuttle 21' is tilted forward causing a sufficient distance in order that bag 40 will move forward along shuttle bottom 30' through the opening of shuttle 21' and extend out of shuttle 21' a sufficient distance to clear said shuttle 21' and approach or touch the ground surface outside container 50'. At this point, liner 40' can be removed from frame 60 and the top of liner 40 can be tied in the typical manner which is outside the scope of this invention. As just described, it is not necessary to lift trash bag liner 40 out of shuttle 21'. As just described, shuttle 21' tilts on its forward bottom edge at hinge 24' where shuttle 21' is connected to dolly 70 by said hinge 24'. Thereafter, a new bag 40' would be placed, as before, on frame 60 either when shuttle 21' is in the tilted position or in an upright position within container 50'.

In addition to emptying and replacing trash bag liner 40', it is also possible to remove the entire shuttle and dolly from container 50'. This is done by first moving arm 82 by grasping handle 83 a sufficient distance toward side 54' such that rods 85 and 86 are retracted a sufficient distance to clear latches 80 and 81. While maintaining said rods 85 and 86 in a retracted position, dolly 70 can be pulled to remove dolly 70 and shuttle 21' from their position within container 50'. Depending upon the height of shuttle 21, door 57 may swing outward allowing sufficient clearance for shuttle 21'. After the interior of container 50' is cleaned and/or the shuttle and dolly are cleaned, then dolly 70 and shuttle 21 can be returned to the position within container 50'. Latches 80 and 81 are constructed and arranged such that the angle of said latches 80 and 81 will cause rods 85 and 86, now in an extended position, to retract until said rods clear the tips of latches 80 and 81, and then said rods 85 and 86 will extend past said latches in order that dolly 70 cannot move out of trash bin 50' until said rods 85 and 86 are retracted by moving arm 82 again.

Additionally, more dollies and shuttles can be used than containers 50 at a specific location such that a trash bag liner 40' does not have to be removed from a shuttle 21 at the site of the trash container 51'. It would only be necessary to place a shuttle 21 with an empty bag 40' within a trash bin 50 after the full bag 40 and shuttle 21 are removed. At such time, the full shuttle and bag 40 can be emptied at a remote location from the bin 51'.

I claim:

1. A trash container comprising: a container having a frontal opening and a floor, a frame having a frontal opening supported on said floor, a removable trash bag liner supported by said frame, said frame connected by a hinge to said floor, said frame tiltable through said frontal opening of said container, wherein said trash bag to be removed is displaced outward from within said frame and moves forward, outward and downward and through said frontal openings wh tilted forward.

2. A trash container as in claim 1, wherein said frame is a structure having a bottom panel, and one or more supporting walls, integrally connected with an open front portion.

3. A trash container as in claim 2, wherein said container has a front door covering said frontal opening, said frame is a U-shaped structure having two side walls and a rear wall, a bag support frame at the top of said U-shaped structure, and said hinge is attached at one end to the open end of said bottom panel and at its other end to the frontal portion of said floor.

4. A trash container comprising: a container having a frontal opening and three walls, a guide attached to the interior portion of said walls, a movable dolly for engagement with said guide, said dolly having a floor supporting a frame having a frontal opening, a removable trash bag liner supported by said frame, said frame connected by a hinge to said floor, said frame tiltable through said frontal opening of said container, wherein said trash bag to be removed is displaced outward from within said frame and moves forward, outward and downward and through said frontal openings when said frame is tilted forward.

5. A trash container as in claim 4, wherein said frame is a structure having a bottom panel, and one or more supporting walls, integrally connected with an open front portion.

6. A trash container as in claim 5, wherein said container has a front door covering said frontal opening, said frame is a U-shaped structure having two side walls and a rear wall, a bag support frame at the top of said U-shaped structure, and said hinge is attached at one end to the open end of said bottom panel and at its other end to the frontal portion of said floor.

7. A trash container as in claim 6, wherein said dolly is held in engagement with said guide by a locking means.

8. A trash container as in claims 4–7, wherein said locking means includes a pair of rods, the tips of said rods are held in an extended position by a spring means and a pair of latches attached to opposite sides of said guide wherein said rods contact said latches to prevent said dolly from moving out of said container.

* * * * *